US005447232A

United States Patent [19]

Chow

[11] Patent Number: 5,447,232

[45] Date of Patent: Sep. 5, 1995

[54] TOOL HOLDER

[76] Inventor: Jessie Chow, No. 18, Hou Juan Road, Taichung, Taiwan

[21] Appl. No.: 336,479

[22] Filed: Nov. 9, 1994

[51] Int. Cl.[6] ..... B65D 69/00; B65D 85/28; B65D 73/00

[52] U.S. Cl. ..... 206/378; 206/372; 206/373; 206/376; 206/377; 206/470

[58] Field of Search ..... 206/372, 373, 374, 376, 206/377, 378, 472, 473, 470, 486, 488

[56] References Cited

U.S. PATENT DOCUMENTS

| | | | |
|---|---|---|---|
| 2,699,865 | 1/1955 | Bowen | 206/373 |
| 4,512,474 | 4/1985 | Harding | 206/470 X |
| 4,641,750 | 2/1987 | Johnson et al. | 206/387 |
| 4,846,346 | 7/1989 | Kime | 206/372 |
| 4,884,689 | 12/1989 | Su-Chin | 206/372 |
| 4,899,877 | 2/1990 | Kiernan | 206/349 |
| 4,951,812 | 8/1990 | Chen | 206/373 X |
| 5,060,814 | 10/1991 | Oglesbee | 206/470 X |
| 5,148,917 | 9/1992 | LeBron | 206/372 |
| 5,203,469 | 4/1993 | Chang et al. | 206/372 X |
| 5,358,113 | 10/1994 | Hellenbrand | 206/411 |

*Primary Examiner*—Steven N. Meyers
*Assistant Examiner*—Tara L. Laster
*Attorney, Agent, or Firm*—Charles E. Baxley

[57] ABSTRACT

A tool holder includes two panels having a bottom portion coupled together by a base so as to form an erectable triangular configuration. One of the panels includes a number of cavities for receiving tools. The other panel includes a number of covers temporarily secured to the other panel and disposed according to the cavities for temporarily covering the cavities so as to retain the tools in the cavities. The cavities are inclined so as to stably retain the tools when the covers are disengaged from the panel.

3 Claims, 3 Drawing Sheets

TOOL HOLDER

BACKGROUND OF THE INVENTION

1. Field of the Invention

The present invention relates to a tool holder, and more particularly to a tool holder for packaging the tools and for displaying and exhibiting the tools.

2. Description of the Prior Art

Typical tool holders comprise a two-part housing including a base and a cover which include a number of cavities formed therein for receiving tools and which may be closed for maintaining the tools therein. The cover should be opened relative to the base such that the tools may be fetched. In addition, the tools may be disengaged from the cavities when the cover is opened relative to the base.

The present invention has arisen to mitigate and/or obviate the afore-described disadvantages of the conventional tool holders.

SUMMARY OF THE INVENTION

The primary objective of the present invention is to provide a tool holder which may stably retain the tools therein and the tools may be fetched without opening the whole tool holder.

In accordance with one aspect of the invention, there is provided a tool holder comprising a base, and two panels including a bottom portion coupled together by the base, the panels being secured together so as to form an erectable triangular configuration, a first of the panels including a plurality of cavities formed therein for receiving tools, a second of the panels including a plurality of covers temporarily secured to the second panel and disposed according to the cavities for temporarily covering the cavities so as to retain the tools in the cavities.

The tool holder includes a vertical axis, the cavities each includes a longitudinal axis inclined relative to the vertical axis so as to stably retain the tools in the cavities when the covers are disengaged from the second panel.

The first panel includes a plurality of caves formed above and communicating with the cavities for facilitating fetching of the tools.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
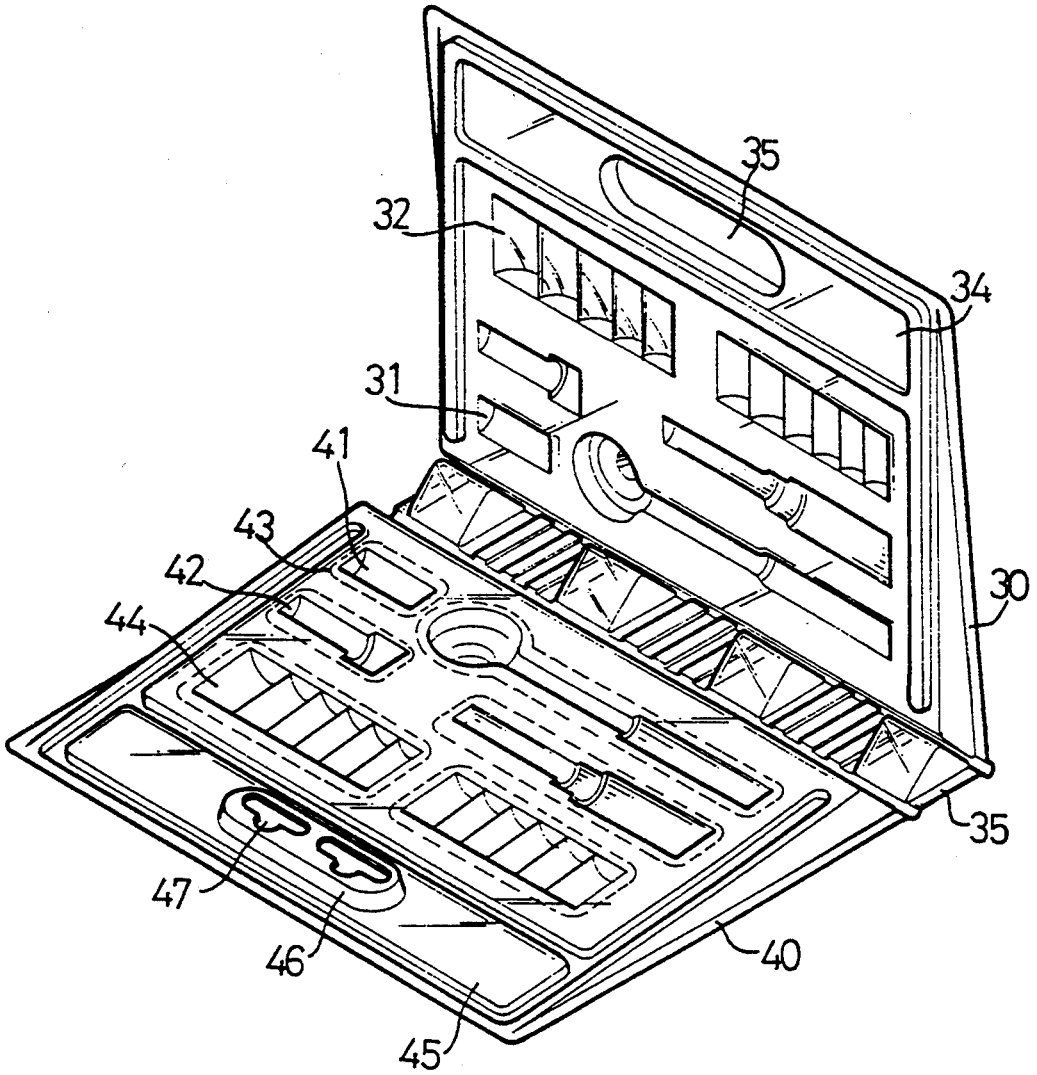
FIG. 1 is a perspective view of a tool holder in accordance with the present invention, in which the housing is in an open position.
Figure 2:
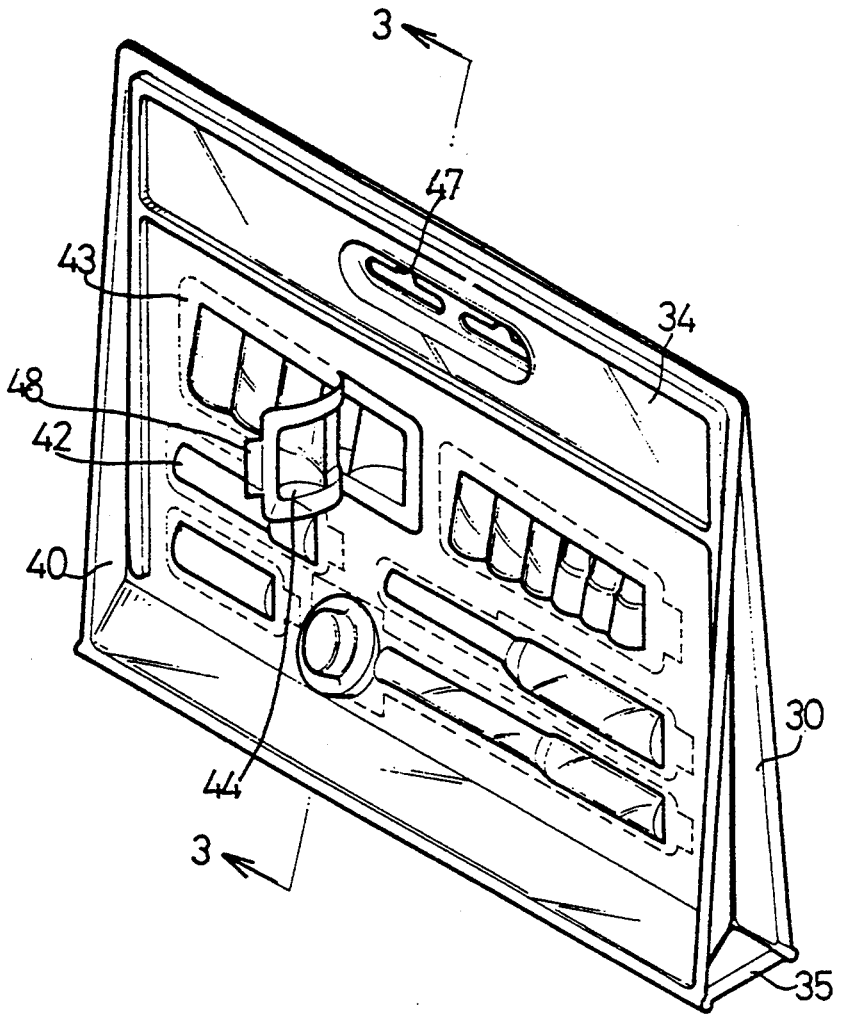
FIG. 2 is a perspective view of the tool holder.
Figure 3:
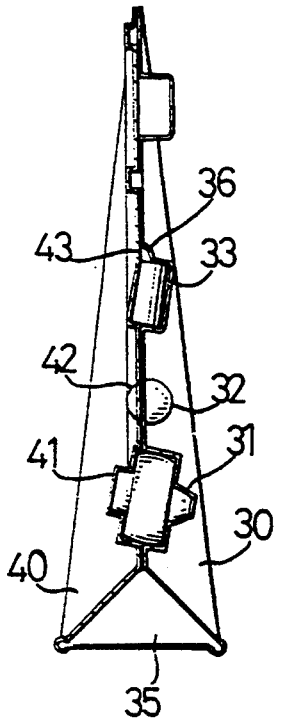
FIG. 3 is a cross sectional view taken along lines 3—3 of FIG. 2.

Referring to the drawings, and initially to FIGS. 1 to 3, a tool holder in accordance with the present invention comprises two panels 30, 40 each including a triangular configuration, and a triangular base portion 35 secured between the bottom portions of the panels 30, 40. The panels 30, 40 include a larger or thicker bottom portion and a smaller or thinner upper portion so as to form a triangular configuration when the panels 30, 40 are secured together, best shown in FIGS. 2 and 3. The tool holder may be erected as shown in FIG. 2 with the base portion 35 arranged in the bottom portion.

The panel 30 includes a number of cavities 31, 32, 33 formed therein for receiving tools 60 therein, and includes a recess 34 formed in the upper portion. An opening 35 is formed in the recess 34. The other panel 40 includes a number of apertures, the panel further has a number of covers 43 which are disposed corresponding to the cavities 31, 32, 33 and overlie said apertures for covering the cavities. The covers 43 each including at least one depression 41, 42, 44 formed therein for engaging with the tools 60, best shown in FIG. 3. The upper portion of the panel 40 includes a protrusion 45 for engaging with the recess 34 and includes a bulge 46 formed thereon for engaging with the opening 35. The bulge 46 includes two holes 47 formed therein for hanging onto wall members. The peripheral portions of the panels 30, 40 may be secured together by adhering materials or by heating processes so as to form an integral and solid configuration as shown in FIG. 2.

Referring again to FIG. 2, the covers 43 are secured to the panel 40 by a number of spaced connecting portions such that the covers 43 may be easily disengaged from the panel 40 when peeling off from the panel 40. The covers 43 may include a flap 48 with which the covers 43 may be easily disengaged or peeled from the panel 40.

Figure 4:
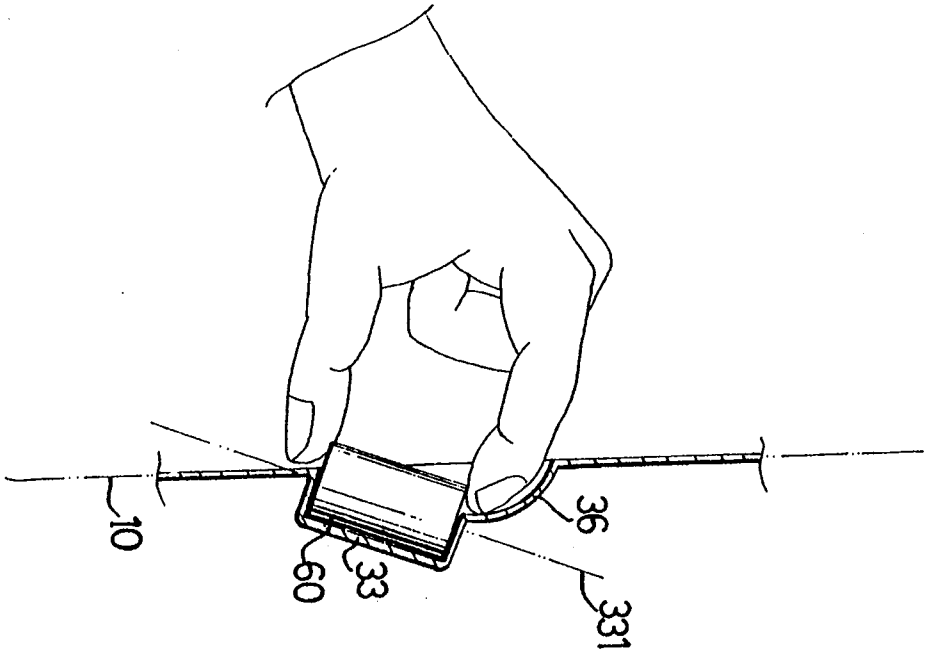
FIG. 4 is an enlarged partial cross sectional of the tool holder.

Referring next to FIG. 4, the panel 30 may further include a number of caves 36 formed above and communicating with the cavities 31, 32, 33 such that the tools 60 may be easily fetched. The longitudinal axis 331 of the cavity 33 is offset (as seen in FIG. 3) relative to the vertical axis 10 of the tool holder such that the tools 60 may be stably retained in the tool holder after the covers 43 are disengaged from the panel 40.

It is preferable that the panels 30, 40 are made of transparent materials such that the tools received therein may be easily seen by the users such that the tool holder may be used for displaying and exhibiting purposes. The users or buyers may see the tools before buying the same. When the covers 43 are disengaged from the panel 40, the tools may also be stably retained in the cavities 31, 32, 33 such that the tool holder may also be used for accommodating and receiving the tools.

Accordingly, the tool holder in accordance with the present invention includes an erectable configuration and includes a number of covers for temporarily covering the tools.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool holder comprising:

a base, and two panels including a bottom portion coupled together by said base, said panels being secured together so as to form an erectable triangular configuration, a first of said panels including a plurality of cavities formed therein for receiving tools, a second of said panels including a plurality of apertures and a plurality of covers temporarily secured to said second panel and covering said apertures, whereby said covers and apertures overlie said cavities for temporarily covering said cavities so as to retain said tools therein.

2. A tool holder according to claim 1, wherein said tool holder includes a vertical axis, said cavities each includes a longitudinal axis offset relative to said vertical axis so as to stably retain said tools in said cavities when said covers are disengaged from said second panel.

3. A tool holder according to claim 1, wherein said first panel includes a plurality of caves formed above and communicating with said cavities for facilitating fetching of said tools.

* * * * *